US007229252B2

(12) United States Patent
Hermiston et al.

(10) Patent No.: US 7,229,252 B2
(45) Date of Patent: Jun. 12, 2007

(54) ROTOR ASSEMBLY RETAINING APPARATUS

(75) Inventors: Brian Hermiston, Derby (GB); Andrew MacNamara, Derby (GB); Kenneth F Udall, Derby (GB); Ian C D Care, Derby (GB)

(73) Assignee: Rolls-Royce plc, London (GB)

( * ) Notice: Subject to any disclaimer, the term of this patent is extended or adjusted under 35 U.S.C. 154(b) by 156 days.

(21) Appl. No.: 10/999,978

(22) Filed: Dec. 1, 2004

(65) Prior Publication Data

US 2006/0088419 A1 Apr. 27, 2006

(30) Foreign Application Priority Data

Oct. 21, 2004 (GB) ..... 0423363.1

(51) Int. Cl.
*F01D 5/32* (2006.01)
*F03B 3/12* (2006.01)

(52) U.S. Cl. ..... 416/220 R; 416/221

(58) Field of Classification Search ..... 416/219 R, 416/220 R, 221, 204 A
See application file for complete search history.

(56) References Cited

U.S. PATENT DOCUMENTS 4,019,833 A 4/1977 Gale
5,622,475 A 4/1997 Hayner
5,662,458 A * 9/1997 Owen ..... 416/145

FOREIGN PATENT DOCUMENTS

| | | |
|---|---|---|
| EP | 1 096 107 A | 5/2001 |
| GB | 928 349 SP | 6/1963 |
| GB | 2 058 945 A | 4/1981 |
| GB | 2 226 367 A | 6/1990 |

* cited by examiner

*Primary Examiner*—Edward K. Look
*Assistant Examiner*—Dwayne J White
(74) *Attorney, Agent, or Firm*—W. Warren Taltavull; Manelli Denison & Selter PLLC

(57) ABSTRACT

A rotor stage (13, 14, 15, 17, 18, 19) of a gas turbine engine (10) comprises an annular retaining plate (38) capable of preventing axial movement of blades (30). The retaining plate (38) is secured to the disc (32) via a bayonet arrangement (49). A locking assembly (48) is provided to prevent relative rotation between the disc (32) and the retaining plate (38). The locking assembly (48) comprises a locking plug (50) configured in a generally Y-shaped cross section having a channel portion defined by arms (56), which engage upstream and downstream of the retaining plate (38) and a leg part (58) configured to span between bayonet parts (40 and 42), thereby preventing relative rotation between the disc (32) and the retaining plate (38). The assembly (48) further comprises a securing plate (52) configured to span between circumferentially adjacent castellations (40) thereby preventing the locking plug (50) disengaging the disc (32) and retaining plate (38).

8 Claims, 3 Drawing Sheets

PRIOR ART

ROTOR ASSEMBLY RETAINING APPARATUS

FIELD OF THE INVENTION

The present invention relates to apparatus for securing and retaining components of a rotor assembly in a turbine engine.

BACKGROUND OF THE INVENTION

In a known rotor assembly of a gas turbine engine, an annular array of blades is radially retained, via cooperating dovetail or fir-tree features, to a rotor disc. It is desirable to provide an annular seal plate to at least the downstream face of the rotor to axially retain the blades. The seal plate also provides a seal to prevent or limit undesirable gas leakage passing therethrough. U.S. Pat. No. 4,019,833 discloses such a retaining plate and rotor disc, each comprising a cooperating annular array of interlocking bayonet features that hold the retaining ring to the rotor disc. The blades engage with the plate to prevent its rotation with respect to the disc and consequent undesirable disconnection. However, it is preferable that the blades are not used for locking the plate as the blades are critical components and any damage caused could compromise their integrity and that of the engine. Furthermore, this prior art arrangement necessitates the fitting of a front retaining plate last and such fitting is difficult and time consuming.

U.S. Pat. No. 5,622,475 recites the use of a split-locking ring to secure an annular retaining plate. However, the split-locking ring, which contacts the disc and the retaining plate, is prone to movement during engine operation and causes fretting against the contact surfaces thus reducing the life of the parts. In certain circumstance, this fretting could initiate undesirable cracking. This arrangement is further disadvantaged in that a full annular locking ring incurs a significant weight penalty, particularly considering it is part of a high-speed rotating assembly.

The Trent 500 aero-engine of Rolls-Royce plc, which entered into service August 2002, comprised a bayoneted retaining ring and a number of locking plugs as shown in FIG. 2. The locking plugs are inserted between castellations on the disc and a retaining plate to prevent relative rotation therebetween. A wire is used to secure the locking plugs in place. However, in service it has been found that the wire is prone to failure partly due to high centrifugal forces and high temperatures.

SUMMARY OF THE INVENTION

Therefore it is an object of the present invention to provide a lock plug and retaining plate assembly, which is lightweight, does not fret against the critical components it touches and does not significantly deform or break under centrifugal and other in-service loads. It is also an object of the present invention to provide a lock plug assembly that is simple and quick to assemble and disassemble.

In accordance with the present invention a locking assembly for a rotor stage of a gas turbine engine, the rotor stage comprising an annular array of radially extending blades secured to a rotor disc via an attachment and an annular retaining plate capable of preventing axial movement of the blades, the retaining plate is secured to an axial face of the disc via a bayonet arrangement, the bayonet arrangement comprising engagable and complimentary castellations on the disc and lands on the retaining plate, characterised in that the locking assembly comprises a locking plug having an arm and a leg part and when assembled the arm engages upstream of a radially inner region of the retaining plate and the leg part is configured to span between and abut both circumferentially adjacent castellations and lands, thereby preventing relative rotation between the disc and the retaining plate.

Preferably, the locking plug is configured in a generally Y-shaped cross section having a channel portion defined by arms and the leg part and when assembled the arms engage upstream and downstream of a radially inner region of the retaining plate.

Preferably, the assembly comprises a securing plate, the securing plate configured to span between circumferentially adjacent castellations thereby preventing the locking plug from disengaging the disc and retaining plate.

Preferably, the securing plate extends across a gap between castellations and is captured at each end within recesses defined in the disc.

Preferably, the securing plate is longer than the gap between recesses such that the locking plate cannot be completely flattened against the locking plug.

Preferably, the securing plate is configured to provided a biasing force to urge its ends into the recesses.

Preferably, the securing plate is formed in any one of the group comprising a W-, V- or U-shape.

Preferably, a gap is defined between the securing plate and the locking plug.

According to a further aspect of the present invention, there is provided a method of assembling a rotor stage comprising the locking assembly comprising the steps of; inserting the locking plug to engage the circumferentially adjacent castellations and lands thereby preventing relative rotation between the disc and the retaining plate, presenting a securing plate in a first bent form so that each end of the plate is presented near to the recesses, and flattening the plate so that the projections engage the recesses thereby preventing the securing plate and importantly the locking plug from falling out during use.

Accordingly there is also provided a method of disassembling a rotor stage comprising the locking assembly comprising the steps of; bending the flattened plate so that the projections disengage the recesses and remove the plate, removing the locking plug from engagement with the circumferentially adiacent castellations and lands.

BRIEF DESCRIPTION OF THE DRAWINGS

The present invention will be more fully described by way of example with reference to the accompanying drawings in which.

DETAILED DESCRIPTION OF THE INVENTION

Figure 1:
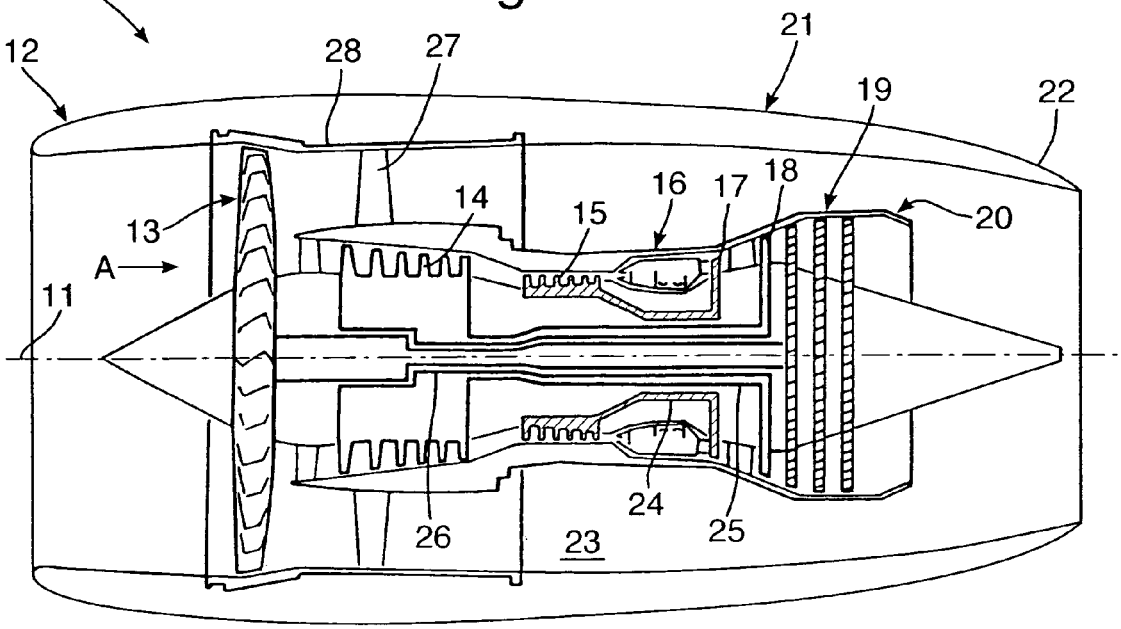
FIG. 1 is a schematic section of part of a ducted fan gas turbine engine incorporating the present invention.

With reference to FIG. 1, a ducted fan gas turbine engine generally indicated at 10 has a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and a core exhaust nozzle 20. A nacelle 21 generally surrounds the engine 10 and defines both the intake 12 and a final exhaust nozzle 22.

The gas turbine engine 10 works in the conventional manner so that air entering the intake 11 is accelerated by the fan 13 to produce two air flows: a first air flow into the intermediate pressure compressor 14 and a second air flow which passes through a bypass duct 23 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high, intermediate and low-pressure turbines 17, 18, 19 respectively drive the high and intermediate pressure compressors 15, 14 and the fan 13 by suitable interconnecting shafts 24, 25, 26.

The fan 13 is circumferentially surrounded by a structural member in the form of a fan casing 28, which is supported by an annular array of outlet guide vanes 27.

The general direction of gas flow through the engine 10 is from left to right as shown by arrow A and the terms downstream and upstream refer to this gas flow direction.

Figure 2:
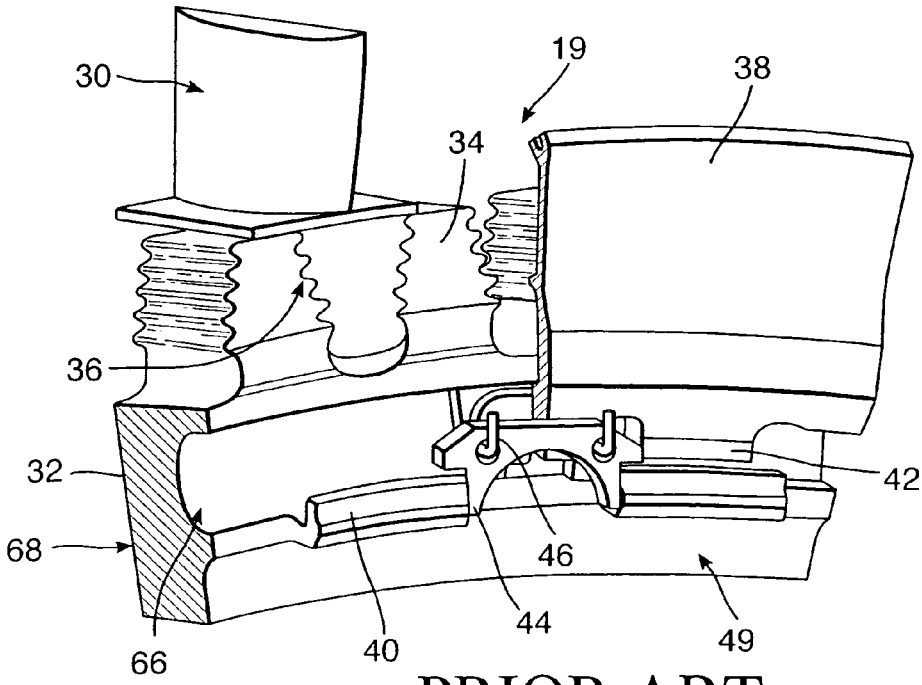
FIG. 2 is a cut away view of a prior art lock plug and retaining plate.

Referring now to FIG. 2, which shows a stage of the high-pressure turbine 17 (HPT) of a Trent 500 aeroengine of Rolls-Royce plc, which entered into service August 2002. The HPT 17 comprises an annular array of blades 30 (only one of which is shown), secured to a rotor disc 32 via complimentary fir-tree root 34 and slot 36 features respectively. From a downstream (axial) surface 66 of the disc 32 extends an annular array of castellations 40, each formed in a hook shape. An annular retaining plate 38, sometimes referred to as a seal plate, comprises similarly spaced lands 42 extending from a radially inner part thereof. This type of arrangement is commonly referred to as a bayonet arrangement 49, such that the lands 42 may engage the hooked castellations 40 on a partial rotation of the plate 38 relative to the disc 32. Thus the plate 38 is prevented from axial movement in the upstream direction by the downstream surface 66 of the disc 32 and in the downstream direction by the bayonet arrangement 40, 42. It should be appreciated that this arrangement may be used on an upstream (axial) surface 68 of the disc 32 to prevent the blades 30 from moving upstream. It should be appreciated that the disc surfaces 66, 68 are substantially perpendicular to the main engine axis 11.

To prevent the retaining plate or ring 38 rotating relative to the disc 32 and thereby disengaging, particularly during acceleration and deceleration of the engine 10, a number of locking plugs 44 are inserted between castellations 40 on the disc and retaining plate 38. The plugs 44 abut between circumferentially adjacent lands 42 and hooks 40, thereby preventing relative rotation between the disc 32 and retaining plate 38. To secure the locking plugs 44, a bent wire 46 is arranged through holes defined in the plugs 44 and is looped radially inwardly and then upstream of the retaining plate 38 and between the disc 32. The wire 46 is used to secure the locking plugs 44 in place, but does not assist in preventing relative rotation of the plate 38 and disc 32 directly.

One problem with this prior art arrangement is that during engine 10 operations, the wire 46 is prone to failure partly due to engine vibrations, the high centrifugal forces and high temperatures. Thus it is possible for the plugs 44 to be released from the assembly, which is clearly undesirable.

It should be appreciated that although the present invention is described with reference to the blades 30 secured to the disc 32 via complimentary fir-tree attachments 36 a dovetail attachment, as known in the art, may be provided instead.

Figure 3:
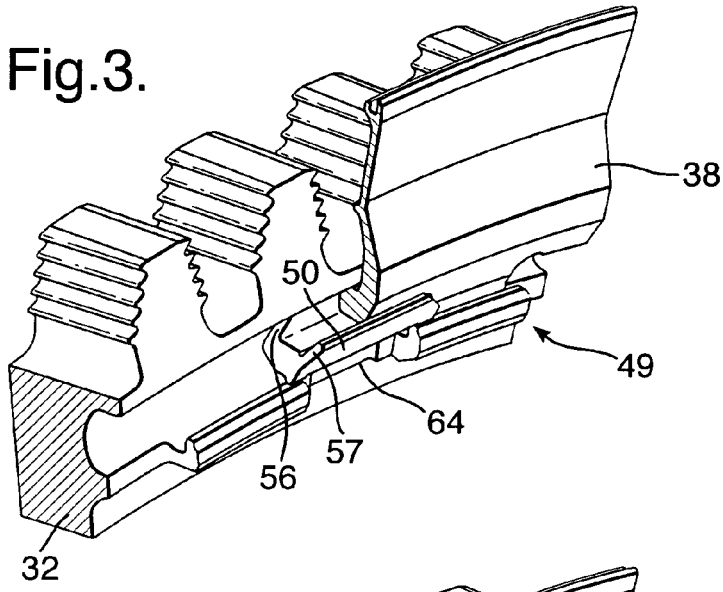
FIGS. 3 to 5 are cut away views of the lock plug and retaining plate and method of assembly of the present invention.
Figure 4:
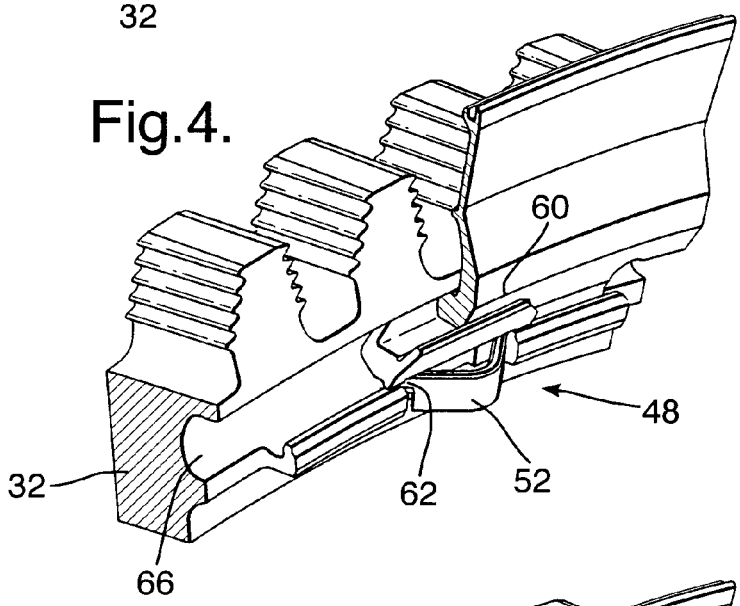
Figure 5:
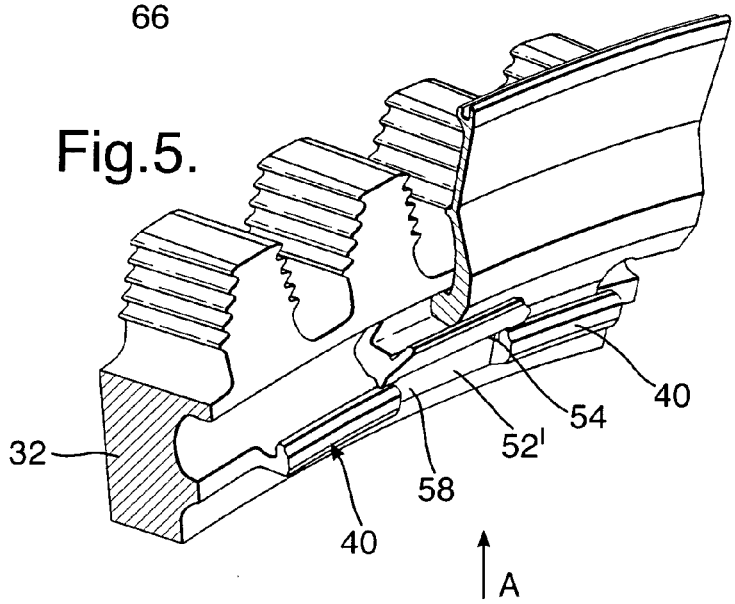

Referring now to FIGS. 3 to 5, where like components are given the same reference numbers as in FIG. 2, the present invention relates to a locking assembly 48 comprising a locking plug 50 and a securing plate 52.

The locking plug 50 is generally Y-shaped in cross section having a channel portion defined by first and second arms 56, 57 and a leg part 58. When assembled, the first and second arms 56, 57 engage upstream and downstream respectively of a radially inner region 60 of the retaining plate 38. When assembled, the leg part 58 is configured to span between and abut circumferentially adjacent castellations 40 and abut the lands 42 of the retaining plate 38. Thus the retaining plate 38 and disc 32 are prevented from relative rotation therebetween.

The purpose of the second arm 57 is to prevent the plug 50 from "falling" upstream and contacting the disc 32, as such contact could cause undesirable fretting therebetween, and subsequently limit the service life of the disc 32. The purpose of the first arm 56, although mechanically redundant, is to engage the and further improve the plug's stability against flutter and frettage. The arm 56 also provides an increased abutment area against the castellations 40 and the lands 42 and therefore reduces wear at these positions. Where the plug 50 is adequately chocked by the securing plate 52, the first arm 56 is not included enabling the plug 50 to be lighter and cheaper to produce.

When assembled to a rotor assembly, such as the HPT 17, the locking plug 50 is itself prevented from falling downstream and radially inwardly via the securing plate 52. The securing plate 52 extends across the gap between castellations 40 and is captured at each end within recesses 54 defined in the disc 32. Preferably, the recesses 54 are defined in the castellations 40. The securing plate 52 is assembled from a first bent form (FIG. 4) so that projections 62 at each end of the plate 52 are presented near to the recesses 54 and then the plate 52 is flattened (FIG. 5) so that the projections 62 engage the recesses 54 thereby preventing the securing plate 52 and importantly the locking plug 50 from falling out during use. Thus it should be appreciated that the length of the securing plate 52 in its flattened form is greater than the circumferential length of the gap between the castellations 40.

It is an advantage of this assembly 48 that when the projections 62 engage the recesses 54, they also abut and force the locking plug 50 against the retaining plate 38. Alternatively, the locking plug 50 is forced against the disc 32. Thus the locking plug 50 is prevented from movement and potential frettage against the disc 32 or retaining plate 38 during use. It should be appreciated that the assembly 48 is capable of thermal expansion and contraction movements without compromising integrity.

The locking plug 50 is further improved by bevelling and shaping edges and corners of the plug, particularly the arms 56 to minimise turbulence and windage. The leg 58 of the plug 50 is shaped to minimise weight and provide a conformal surface to the surrounding geometry 40, 42 again to minimise windage. Whereas the plug 50 is preferably metallic, alternatively part or all of plug 50 may be hollow or made from foamed or composite material to reduce weight whilst retaining strength.

Figure 6A:
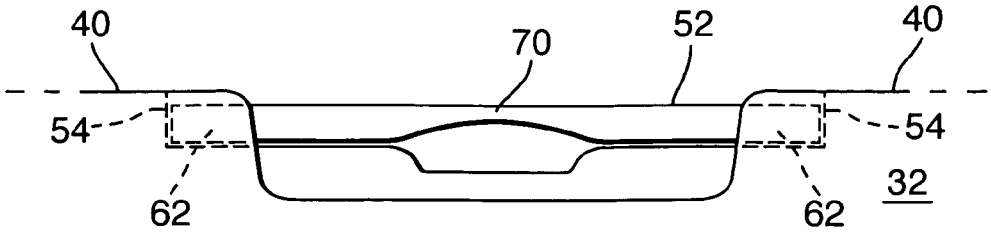
FIGS. 6A and B are views on arrow A in FIG. 5 and show detail of the lock plate of the present invention.
Figure 6B:
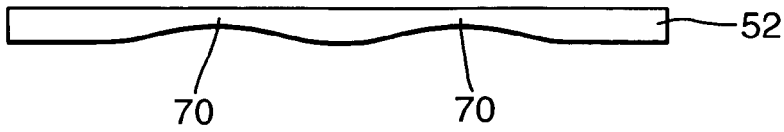

To assist in the removal (disassembly) of the securing plate 52, a channel or other feature may be formed in a surface of the leg 58 of the plug 50 or the securing plate itself. For example, a chamfer 64 is formed in a lower edge of the downstream facing surface of the leg 58. This chamfer 64 forms a gap between the leg 58 and the securing plate 52 offering purchase for a tool to remove the securing plate 52. Alternatively, as shown in FIGS. 6A and B, the securing plate 52 is formed with at least one waist 70 to enable the securing plate 52 to be bent more easily into substantially flat or slightly arcuate shape for improved removal. This is particularly useful where the plate is thickened to produce a close, aerodynamic fit profile across the bayonet gap.

The securing plate 52 may be made slightly longer than the extent between recesses 62 such that when installed it cannot be perfectly flattened. This prevents over-bending of the plate 52 such that it is bent away from the plug 50 thereby defining a removal gap for engagement by a removal tool. Although, this would be not ideal in terms of locking, it does provide the benefit that differential temperature growth will be taken up by increased bending of the securing plate 52 in a known and controllable manner without putting excess strain on the bayonet features.

One advantage of the present invention is that the assembly 48 is configured so that its centre of gravity is axially aligned with that of the lock ring 38, i.e. it is in the same radial path. Thus there are no unbalanced forces to cause the assembly 48 to dislocate in service. A further advantage is that the assembly 48 is substantially aerodynamically unobtrusive which reduces windage losses.

One important aspect of the securing plate 52 is its inherent radial stiffness (in its inserted location and position), which is sufficiently stiff to prevent it bending out of location. Consideration of the required radial stiffness comprises the securing plate's 52 radial thickness, the properties of the material throughout the temperature range and centrifugal forces experienced.

Figure 7A:
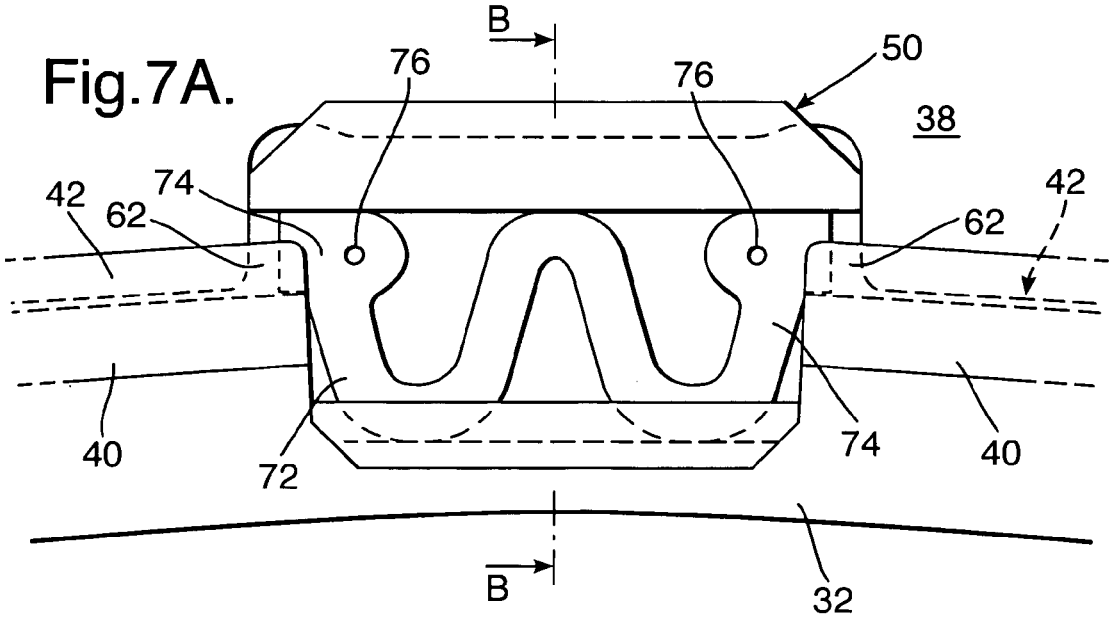
FIG. 7A is a view of an alternative embodiment of the lock plate of the present invention.

Referring now to FIG. 7A, an alternative securing device 72 is formed generally in a W-shape and is biased to provide a force to engage each of its ends 74 in the recesses 62 and thereby prevent the locking plug 50 disengaging the rotor assembly. Engagement features, such as holes 76, are formed in the ends 74 such that a tool is capable of engaging the device 72. Thus to insert the securing device 72, the ends 74 of the compressed device 72 are presented to the recesses 62 and release of the tool allows the ends 74 to engage the recesses 62. It should be apparent to the skilled person that alternative shapes of securing device 72 are possible, each biased for an engagement force. For example, U- or V-shapes are equally adaptable.

Figure 7B:
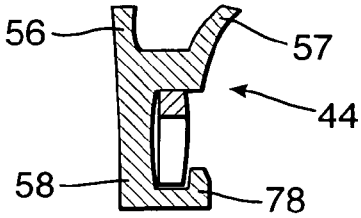
FIG. 7B is a section through B—B on FIG. 7A.

In FIG. 7B, the leg 58 further comprises a hook portion 78, generally extending in the downstream direction, arranged to prevent rotation and possible failure of the securing device 72.

The present invention also lends itself to a method of assembling a rotor stage 17 comprising the locking assembly 48 as hereinbefore described. The method comprises the steps of;

a) inserting the locking plug 50 to engage the circumferentially adjacent castellations 40 and lands 42 thereby preventing relative rotation between the disc 32 and the retaining plate 38, b) presenting a securing plate 52 in a first bent form 52 so that each end of the plate 52 is presented near to the recesses 54, c) and flattening the plate 52 so that the projections 62 engage the recesses 54 thereby preventing the securing plate 52–52' and importantly the locking plug 50 from falling out during use.

It should therefore be appreciated that a further aspect of the present invention is a method of disassembling a rotor stage 17 comprising the locking assembly 48 hereinbefore described comprising the steps of;

a) bending the flattened plate 52' so that the projections 62 disengage the recesses 54 and remove the plate 52, b) removing the locking plug 50 from engagement with the circumferentially adjacent castellations 40 and lands 42.

Once the locking assembly has been disassembled and removed the retaining plate 38 is rotated so that the lands 42 are aligned with the gap between castellations 40 and then removed from the disc 32. The individual blades may then be removed from their fir-tree attachments.

The present invention is simpler and faster to assemble and disassemble without requiring the specialist tooling needed for the prior art bent wire arrangement.

The present invention is equally applicable to any of the rotor arrangements 13, 14, 15, 17, 18, 19 of a gas turbine engine 10 and the engine 10 may be any one of the group comprising an aero, an industrial, a marine engine or a steam or water turbine.

We claim:

1. A locking assembly for a rotor stage of a gas turbine engine, said rotor stage comprising an annular array of radially extending blades secured to a rotor disc via an attachment and an annular retaining plate capable of preventing axial movement of the blades, said retaining plate being secured to an axial face of the disc via a bayonet arrangement, said bayonet arrangement comprising engagable and complimentary castellations on the disc and lands on the retaining plate, characterised in that the locking assembly comprises a locking plug having an arm and a leg part and when assembled said arm engages upstream of a radially inner region of the retaining plate and said leg part being configured to span between and abut both circumferentially adjacent castellations and lands, thereby preventing relative rotation between the disc and the retaining plate wherein said locking plug is configured in a generally Y-shaped cross section having a channel portion defined by arms and said leg part and when assembled said arms engage upstream and downstream of a radially inner region of the retaining plate wherein the assembly comprises a securing plate, the securing plate spanning between circumferentially adiacent castellations thereby preventing the locking plug from disengaging the disc and retaining plate.

2. A locking assembly as claimed in claim 1 wherein the securing plate extends across a gap between castellations and is captured at each end within recesses defined in the disc.

3. A locking assembly as claimed in claim 2 wherein the securing plate is longer than the gap between recesses such that the locking plate cannot be completely flattened against the locking plug.

4. A locking assembly as claimed in claim 1 wherein the securing plate is configured to provide a biasing force to urge its ends into the recesses.

5. A locking assembly as claimed in claim 4 wherein the securing plate is formed in any one of the group comprising a W-, V- or U-shape.

6. A locking assembly as claimed in claim 1 wherein a gap is defined between the securing plate and the locking plug.

7. A method of assembling a rotor stage comprising the locking assembly as claimed in claim 1 comprising the steps of;

a) inserting the locking plug to engage the circumferentially adjacent castellations and lands thereby preventing relative rotation between the disc and the retaining plate, b) presenting a securing plate in a first bent form so that each end of the plate is presented near to the recesses, c) and flattening the plate so that the projections engage the recesses thereby preventing the securing plate and importantly the locking plug from falling out during use.

8. A method of disassembling a rotor stage comprising the locking assembly as claimed in claim 1 comprising the steps of;

a) bending the flattened plate so that the projections disengage the recesses and remove the plate, b) removing the locking plug from engagement with the circumferentially adjacent castellations and lands.

* * * * *